US008201829B2

(12) United States Patent
Belete et al.

(10) Patent No.: US 8,201,829 B2
(45) Date of Patent: Jun. 19, 2012

(54) STACK AND AVOID GAME

(76) Inventors: Tewabtch Belete, San Francisco, CA (US); Marechet Belete, San Francisco, CA (US)

( * ) Notice: Subject to any disclaimer, the term of this patent is extended or adjusted under 35 U.S.C. 154(b) by 0 days.

(21) Appl. No.: 13/103,054

(22) Filed: May 7, 2011

(65) Prior Publication Data

US 2011/0260397 A1 Oct. 27, 2011

Related U.S. Application Data

(62) Division of application No. 12/383,029, filed on Mar. 19, 2009, now abandoned.

(51) Int. Cl.
*A63B 67/00* (2006.01)

(52) U.S. Cl. ..... 273/317; 273/440; 473/465

(58) Field of Classification Search ..... 273/351, 273/353, 398–402, 317, 440; 473/465
See application file for complete search history.

(56) References Cited

U.S. PATENT DOCUMENTS

| | | | | |
|---|---|---|---|---|
| 2,430,681 | A | 11/1947 | Johnson | |
| 2,520,392 | A | 8/1950 | Flenghi | |
| 3,024,024 | A | 3/1962 | Chalcroft | |
| 3,761,087 | A | 9/1973 | Meyer | |
| 4,017,076 | A | 4/1977 | Bai | |
| 4,325,556 | A * | 4/1982 | DeCanto et al. | 273/393 |
| 4,330,130 | A | 5/1982 | Carr | |
| 4,378,944 | A | 4/1983 | Johnston | |
| 4,453,713 | A | 6/1984 | Guyer | |
| 4,718,677 | A | 1/1988 | Barnes | |
| 4,744,567 | A | 5/1988 | Kochmanski et al. | |
| 4,986,548 | A | 1/1991 | Conner | |
| 5,082,291 | A | 1/1992 | Appel et al. | |
| 5,139,273 | A * | 8/1992 | Rudell et al. | 273/348.4 |
| 5,348,306 | A | 9/1994 | Strishak et al. | |
| 5,624,121 | A * | 4/1997 | Stern | 273/317 |
| 5,707,062 | A * | 1/1998 | Perillo et al. | 273/354 |
| 5,873,573 | A | 2/1999 | Beatty, Jr. | |
| 6,352,262 | B1 * | 3/2002 | Looney | 273/290 |
| 6,843,478 | B1 | 1/2005 | Hoepelman | |
| 6,899,336 | B2 * | 5/2005 | Michelet et al. | 273/400 |
| 7,360,767 | B2 | 4/2008 | Merccica | |
| 7,611,427 | B1 * | 11/2009 | Cline | 473/465 |
| 2003/0025267 | A1 * | 2/2003 | Stubberfield | 273/118 A |
| 2007/0187891 | A1 | 8/2007 | Hoeting | |

* cited by examiner

*Primary Examiner* — Mark Graham
(74) *Attorney, Agent, or Firm* — Michael J. O'Connell

(57) ABSTRACT

This invention, stack and avoid game, presents a method of playing a tag game with stackable figures, a projectile and three or more players. The method of playing this tag game requires at least three players; the suggested number being two teams composed of two members each. One team tries to tag all members of the other team before all the stackable figures are stacked up. The opposing team tries to stack up the stackable figures before all team members are tagged out. If at least one member of the tagged team finishes stacking up the stackable figures while avoiding being tagged, s/he will be able to bring back tagged team members back in the game. If the tagger's team has achieved tagging everyone before all stackable figures are stacked-up, the teams will change roles. Using three players will exclude the capacity of players bringing back tagged team members.

9 Claims, 2 Drawing Sheets

STACK AND AVOID GAME

CROSS-REFERENCE TO RELATED APPLICATIONS

This application is a divisional application of U.S. patent application Ser. No. 12/383,029 filed on Mar. 19, 2009, now abandoned the contents of which is hereby incorporated by reference in its entirety.

FEDERALLY SPONSORED RESEARCH

Not applicable.

SEQUENCE LISTING OR PROGRAM

Not applicable.

BACKGROUND OF THE INVENTION

1 Field of the Invention

This invention generally relates to games involving throwing a projectile, particularly to target games involving throwing a ball and tagging opposing team members.

2. Prior Art

Target game, very old in introduction, has been changing and evolving over time due to creative minds. The target game, U.S. Pat. No. 4,017,076, makes use of a plastic ball that is partially covered with velcro strip to be tossed from one player to the other to be caught by the fabric target glove or dish shaped mitt. While the throw and catch game, U.S. Pat. No. 4,718,677, contains a projectile covered with a velcro material, the projectile is caught by the knees or elbows receivers. The mentioned inventions objective is for one player to throw a projectile covered with bonding material for another player to receive the projectile by a glove or knee and elbow receivers partially covered with bonding material.

Of particular interests to our invention are body ball tag game and projectile and target game apparatus. Body ball tag game, U.S. Pat. No. 4,986,548, involves a projectile with velcro pad to be thrown at a person wearing a front and back uniform with velcro hook target. Projectile and target game apparatus, U.S. Pat. No. 5,082,291, involves at least one projectile and one cap. All of the inventions mentioned above are developed with the intention for all ages. These games develop some sort of coordination between eye and hand, arms, legs and/or upper body.

The reason the two inventions, U.S. Pat. No. 4,986,548 and U.S. Pat. No. 5,082,291, particularly grasp our attention is because the games can be played with opposing teams, where one throws a projectile with the intention of tagging the opponent who tries to avoid being hit. Even if the above mentioned inventions grasp our attention, there is no mention of a tag game with stackable figure. In addition there is no mention of ways of bringing back tagged team mates, while playing these games. Our invention, stack and avoid game, is a game that involves stacking up stackable figures while trying to avoiding being tagged by a projectile. When four or more people are playing stack and avoid game, if at least one team member accomplishes stacking up all the plugs while avoiding being tagged, all the team members that were tagged out can get back in the game. As you read further, it will become obvious that this invention differs' from target games known to the art.

OBJECTS AND ADVANTAGES

The stack and avoid game is designed to be played with stackable figures and a projectile; though there is no restrain on the number of stackable figures used, the suggested number for the stackable figures is at least six. The stack and avoid game can be played by three people; with one person in the middle as the tagged and the other two people as the taggers. But it is suggested that there be two sets of teams with each team comprised of at least two members; doing that will make the game more exciting by enabling the incorporation of the capacity to bring back tagged out team mates. The tagged team's members will try to stack up all the stackable figures before the opposing team members' tag everyone out. If at least one team member of the tagged team accomplishes stacking up all the stackable figures while avoiding being tagged, all his/her team mates that were tagged out will get back in the game. The opposing team members will throw the projectile with the intention of trying to tag all members of the tagged team before they finish stacking up the stackable figures. When the tagger's team has tagged everyone out before all the stackable figures are stacked up, they will change rolls with the tagged team. The primary objective of the game is to stack up all the stackable figures before all team members are tagged out by the opposing team. Accordingly, objects and advantages of our invention incorporate the intention:

(a) to have stackable figures that can be used by all ages.
(b) to have projectile apparatus that can be used by all ages.
(c) to allow eye, upper body and/or lower body coordination.
(d) to provide a stack and avoid game in which the tagged team's members try to stack up all the stackable figures while avoiding the projectile thrown by the other team members.
(e) to provide a stack and avoid game in which the tagger team's members will try to tag out all the tagged team members, before they finish stacking up the stackable figures.
(f) to create a game that has a way of bringing back tagged out team mates.
(g) to create a game that could be played in a limited & unlimited space; unlimited being a much bigger or wider space than the imaginary rectangular space that would be set while playing in a limited space.

Further, it is an objective of the present invention to provide a challenging game that requires constant collaboration of team members. These and other objects of the invention will become obvious upon reading the following specifications.

SUMMARY

A stack and avoid game played with a projectile and stackable figures; where one team's members try to tag all members of the other team, before they finish stacking up the stackable figures.

DRAWINGS: FIGURES

In the drawing, closely related figures have the same number but different alphabet.

REFERENCE NUMERALS

Figure 1:
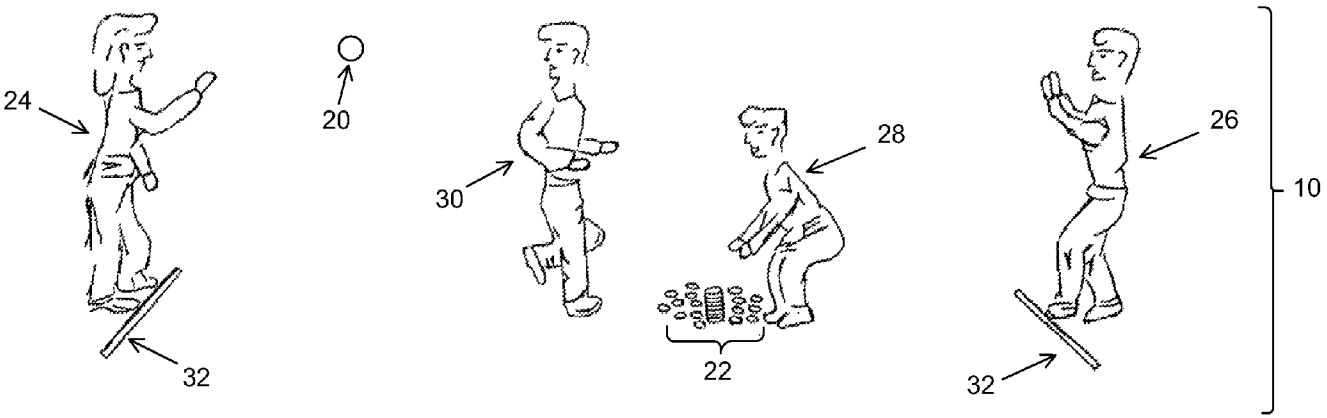
FIG. 1 is a side representation of limited space version of the game being played by four players and with more than six stackable plugs.
Figure 2:
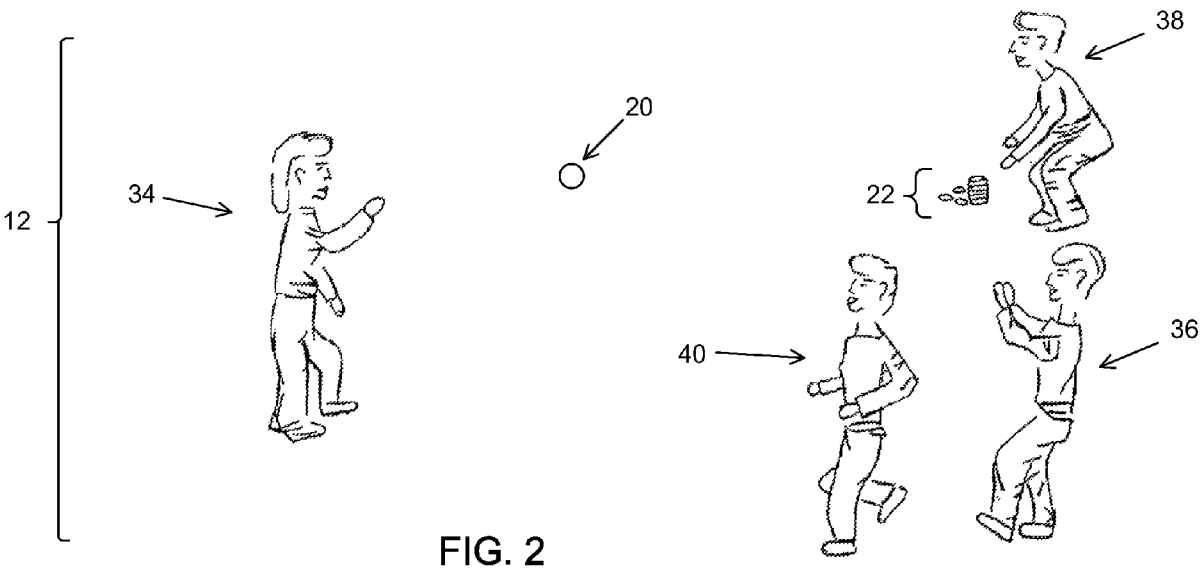
FIG. 2 is a side representation of unlimited space version of the game being played by four players with six stackable plugs; unlimited being a much bigger or wider space than the imaginary rectangular space that would be set while playing the limited space version of the game.

10 limited space of FIG. 1
12 unlimited space of FIG. 2
20 ball
22 plug
24 one of the taggers on FIG. 1
26 the other tagger on FIG. 1
28 one of the tagged team member on FIG. 1
30 the other tagged team member on FIG. 1
32 Boundary mark
34 one of the taggers on FIG. 2
36 the other tagger on FIG. 2
38 one of the tagged team member on FIG. 2
40 the other tagged team member on FIG. 2
42 the base of the plug
44 top part of the plug
46 the downward curving part of the plug
48 length of the boundary mark maker
50 width of the boundary mark maker

DETAILED DESCRIPTION

To play the game the preferred gears needed are shown on FIG. 3A to FIG. 3C and FIG. 4; suggested at least six stackable plugs 22 and a foam ball 20. If there are less than suggested four people, three people, each person could play as a single team. Those involved in the game can chose who will be the first to be tagged. If the tagged person is able to finish stacking up the figures while avoiding being tagged, it will be considered a point. But if the person is tagged out, the person will switch roles with the second person chosen to be tagged. And at the end of the game, when all three people have been able to play and the game is finished, the person with the most points will be considered the winner. As suggested if there are four or more people playing the game, the tagged team's members will try to avoid being tagged by the foam ball 20 thrown at them by the opposing team members and try to stack up all the plugs 22 before everyone in their team is tagged out. When the opposing team's members tag all members of the tagged team before they stack up all the plugs 22, the teams change roles; the tagged team will be the tagger team and vise versa.

The foam ball 20 is made up of a foam material and its diameter is approximately two point five inches (2.5".) The factors required are for the ball 20 to be thrown to a reasonable distance and soft enough to avoid injuries. There are other materials and shapes that might be used to make the projectile 20 besides the suggested foam ball. The plug 22 is made from plastic. As shown on FIG. 3A, FIG. 3B, and FIG. 3C, the plug 22 is made to look like a small cup with a downward curve starting at the top. The plug's base 42 is approximately 0.45 inch in radius, the top part 44 radius is approximately 0.50 inch and size of the downward curved part 46 is about 0.17 inch all around the top part 44. The difference in the diameter between the base 42 and the top part 44 of the plug 22 makes it easy to stack up one plug on top of any other plug with the same dimensions. At the same time, the structure and dimensions of the plug 22 avoids one plug from being stuck strongly into another plug. Of course, varieties of designs are feasible to substitute the plug 22 mentioned as preferred embodiments. The requirements for feasible substitute designs of the stackable plug are for the figure to be stackable and have reasonably acceptable size.

The main concept of the game is for the tagged team members to stack up all the plugs 22 before all their team mates get tagged out; doing that will give their tagged out team members another chance at getting back in the game. When the opposing team members tag all the tagged team members before they finish stacking up the plugs, the teams will change roles. There are two possible ways of playing this game.

Figure 5A:
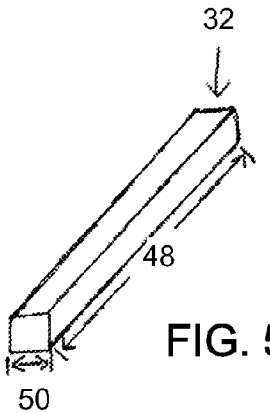
FIGS. 5A and 5B are two different sides view of a rectangular cube foam figure that could be used to make boundary marks.
Figure 5B:
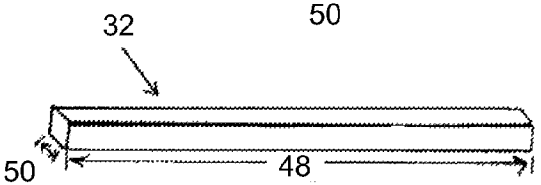
Figure 4:
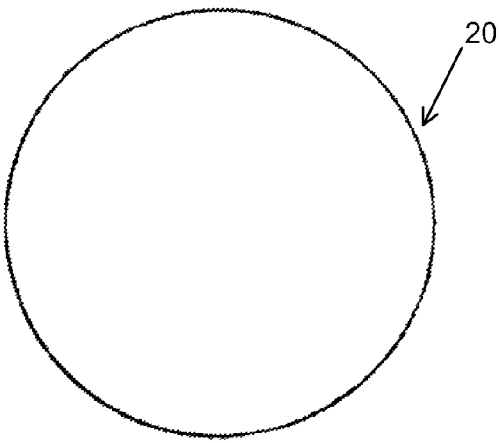
FIG. 4 is a side view of a foam ball that is in agreement with the concept of the invention.
Figure 3A:
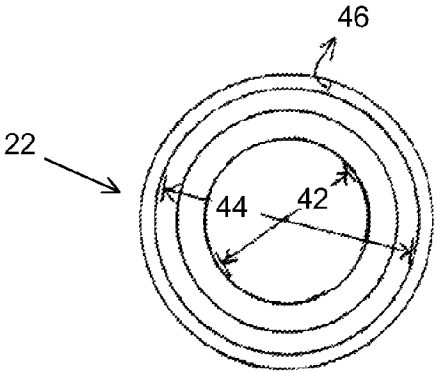
FIGS. 3A to 3C is a bird's eye, an internal, and a side view of a stackable plug constructed in accordance with the concepts of the invention and used in the game illustrated both in FIG. 1 and FIG. 2.
Figure 3B:
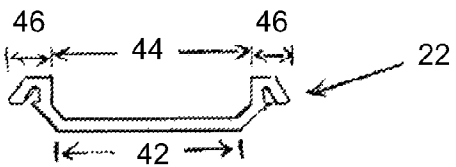
Figure 3C:
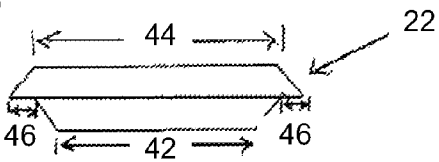

One way of playing the game is in a limited space 10 with a foam ball 20 and plugs 22. As seen on FIG. 1, when playing the game in a limited space it is recommended that there be at least four people 24, 26, 28 and 30 and at lest six plugs 22. The number of the plugs 22 can be decreased to make the game easier or increased to make the game a bit difficult. Twelve is the suggested number of plugs when playing the game with total number of four people; two people on each team. It is also recommended to increase the plugs by six when a person is added on each team. Even if the game can be played by more than four people we will use the minimum suggested number to explain the game, as seen on FIG. 1. The taggers 24 and 26 will stand at about approximately twenty feet apart and at approximately ten feet in the middle on a designated spot the plugs 22 will be placed. FIG. 5A and FIG. 5B illustrate a rectangular foam figure that could be used as a boundary mark 32 to make sure that the taggers will not violate the twenty feet distance excessively to get close to the tagged team members. The rectangular boundary mark 32 has an approximate length of 14 inches, width of 1 inch and height of 1 inch. There are other materials or means that are feasible to substitute the rectangular cube for making the boundary mark. The only requirement for a substitute is having something that is visible enough to serve as a boundary mark. At about twenty feet apart, the taggers 24 and 26 collaborate by passing the ball 20 back and forth and throwing the ball 20 at the tagged team members 28 and 30 trying to tag them out. During the game, the tagged team members 28 and 30 who are in the middle are required not to wander more than approximately four feet apart to the right and left of the center; the imaginary line that starts from one side of the boundary mark 32, passes through the designated spot of the stackable plugs 22 and ends at the other side of the boundary mark 32. As long as they don't wander off too far on the sides and go past the boundary mark 32, the tagged team members 28 and 30 can move back and forth freely while trying to avoid being tagged when stacking up the plugs 22. There is an option for the people playing the game to decide if they want to have or create penalties for wandering excessively outside boundaries. For example, a tagged player who steps outside the boundaries excessively three times could be considered as tagged out or six stacked up plugs can be taken apart. On the other hand if the tagger's violate the boundary mark excessively three times they could give one lifeline for one tagged out opposing team member. However, it is up to the people playing the game to decide to have a penalty or not. If one of the tagged team members 30 was tagged and the other team member 28 was left to be tagged and s/he managed to finish stacking up the plugs 22, s/he will be able to bring her/his tagged team mate 30 back in the game. If the taggers 24 and 26 tagged the opposing team members 28 and 30 before they finished stacking up all the plugs 22, they will switch rolls with the tagged team. If more than four people are playing the game the tagger's team members are all allowed to participate in tagging anyway they want as long as all of them are behind the boundary mark 32. For the tagged team members who will be in the middle, it is possible for all of them to get in at once; but it is suggested that two people get in and whenever one person gets tagged another person gets in. Doing this will make it less crowded, both for effectively moving back and forth in the area available and stacking up the plugs 22.

Another way of playing the game is in an unlimited space 12 with a foam ball 20 and plugs 22; unlimited space being a much bigger or wider space than the imaginary rectangular space that would be set while playing the limited space version of the game. As seen on FIG. 2, when playing the game in an unlimited space, it is recommended to use six plugs 22 and four is the suggested minimum number of people 34, 36, 38 and 40. Even if the recommended number of plugs 22 is six, there is an option of decreasing or increasing the number of plugs. There will be a designated spot chosen in this big area for the plugs 22. It up to the people playing the game to decide how they want to select which team will be the tagger or the tagged first. The taggers 34 and 36, on FIG. 2, will be allowed to move around following the tagged team members 38 and 40 as long as the ball is not in their hand. Every time one of the taggers', 34 or 36, holds the ball 20 s/he has to stay in the same spot until s/he passes the ball 20 to her/his team mate or throws it at the opposing team members 38 or 40. The tagging team members 34 and 36 collaborate with each other by passing the ball 20 back and forth and throwing the ball 20 to tag the tagged team members 38 or 40. If the taggers 34 and 36 tag everyone out, they will switch rolls with the opposing team 38 and 40. The opposing team 38 and 40 on the other hand will move around freely trying to stack the plugs 22 before everyone is tagged. If there is one team member 38 or 40 left to be tagged and finishes stacking up all the plugs 22 while avoiding being tagged, s/he will be able to bring her/his tagged team mate back in the game. Since there is enough space to avoid over crowdedness, when more than four people are playing this way, it is recommended that everyone in both teams get in the game to tag or to be tagged. If there are less than four people, three people, each person could play as a single team. Those involved in the game can chose who will be the first to be tagged. If the tagged person finishes stacking up the plugs 22 while avoiding being tagged, it will be considered a point. But if the person is tagged out before finishing stacking up the plugs 22, the person will switch roles with the second person in line. At the end of the game, when all three people have been able to play and the game is finished, the person with the most points will be considered the winner.

To make the game a bit more challenging while trying to determine which team gets to be tagged first it is recommended that the plugs 22 be stacked up at the designated location. Once the plugs 22 are stacked up, the team chosen to go first by the players will get four chances to break the stacked up plugs 22 from about eight feet. The team members can attempt to break the stacked up plugs by tossing or rolling the ball 20. If the team who gets the first four chances fails to break the stacked up plugs 22, the other team will also get four chances to break the plugs 22. The teams will switch turns until one team breaks the stacked up plugs 22. The team who breaks the stacked up plugs 22 gets to decide if they want to be the tagged or the tagger. This way of starting off the game is suggested in both limited and unlimited ways of playing the game. At the same time, there are other methods that are feasible to substitute the way of picking roles for the teams at the beginning of the game.

The distances and descriptions above are means of illustration not means of limitations. Although the materials and designs mentioned above are recommended, other modifications to materials and designs of the stackable figures, projectile, and boundary maker are feasible without departing from the spirit and scope of the invention.

We claim:

1. A method of playing a stack and avoid game comprising:

placing a plurality of stackable figures within a tagging area of a playing surface, each of the stackable figures residing separately from others of the stackable figures;

stacking two of the stackable figures within the tagging area by a first team, the two stackable figures forming a stack; and throwing a soft projectile at a member of the first team by a tagger of a second team in an attempt to tag the member of the first team while the first team attempts to stack an additional stackable figure on the stack.

2. The method of claim 1 wherein each of the stackable figures comprises a disk shape that includes a base that forms a plug and an upper part that forms a cup.

3. The method of claim 2 wherein first and second stackable figures of the plurality of stackable figures are stacked by inserting the plug of the first stackable figure into the cup of the second stackable figure.

4. The method of claim 1 further comprising making the member of the first team an inactive member for a round of play upon the tagger of the second team tagging the member.

5. The method of claim 4 further comprising ending the round of play in favor of the second team if the tagger of the second team successfully tags all members of the first team before the first team stacks all of the stackable figures.

6. The method of claim 5 further comprising:

switching roles by the first and second teams, the first team becoming a new second team and the second team becoming a new first team; and beginning a new round of play.

7. The method of claim 1 further comprising ending a round of play in favor of the first team upon successful stacking of all of the stackable figures by the first team.

8. The method of claim 1 wherein the playing surface further comprises a boundary that separates the tagging area from a throwing area and further comprising assessing a penalty for a tagger of the second team entering the tagging area or an active member of the first team leaving the tagging area.

9. The method of claim 1 wherein the tagging area comprises an unlimited tagging area and further comprising remaining within a fixed spot of the throwing area by the tagger of the second team while the tagger of the second team possesses the soft projectile.

* * * * *